US011342686B2

(12) United States Patent
Kim et al.

(10) Patent No.: US 11,342,686 B2
(45) Date of Patent: May 24, 2022

(54) FILM ANTENNA AND DISPLAY DEVICE COMPRISING SAME

(71) Applicants: DONGWOO FINE-CHEM CO., LTD., Jeollabuk-do (KR); KREEMO INC., Seoul (KR)

(72) Inventors: Jong Min Kim, Gyeonggi-do (KR); Dong Pil Park, Incheon (KR); Yoon Ho Huh, Seoul (KR); Won Bin Hong, Seoul (KR)

(73) Assignees: DONGWOO FINE-CHEM CO., LTD., Jeollabuk-Do (KR); KREEMO INC., Seoul (KR)

( * ) Notice: Subject to any disclaimer, the term of this patent is extended or adjusted under 35 U.S.C. 154(b) by 0 days.

(21) Appl. No.: 16/929,309

(22) Filed: Jul. 15, 2020

(65) Prior Publication Data

US 2020/0350695 A1 Nov. 5, 2020

Related U.S. Application Data

(63) Continuation of application No. PCT/KR2019/000778, filed on Jan. 18, 2019.

(30) Foreign Application Priority Data

Jan. 18, 2018 (KR) ..... 10-2018-0006484

(51) Int. Cl.
*H01Q 21/06* (2006.01)
*H01Q 1/22* (2006.01)
*H01Q 9/16* (2006.01)

(52) U.S. Cl.
CPC ..... *H01Q 21/065* (2013.01); *H01Q 1/2283* (2013.01); *H01Q 9/16* (2013.01)

(58) Field of Classification Search
CPC ..... H01Q 21/06; H01Q 21/065; H01Q 21/08; H01Q 1/2283; H01Q 1/243; H01Q 9/04;
(Continued)

(56) References Cited

U.S. PATENT DOCUMENTS 6,320,546 B1 11/2001 Newton et al.
9,537,216 B1 * 1/2017 Kontopidis ..... H01Q 3/26
(Continued)

FOREIGN PATENT DOCUMENTS

CN 101335371 A 12/2008
JP H03-151702 A 6/1991
(Continued)

OTHER PUBLICATIONS

Office action dated Jun. 22, 2021 from Japan Intellectual Property Office in a counterpart Japanese Patent Application No. 2020-538932 (all the cited references are listed in this IDS.) (English translation is also submitted herewith.).
(Continued)

*Primary Examiner* — Jason Crawford
(74) *Attorney, Agent, or Firm* — The PL Law Group, PLLC

(57) ABSTRACT

A film antenna according to an embodiment of the present invention includes a dielectric layer, and a plurality of radiation patterns commonly arranged on an upper surface of the dielectric layer and forming a phased array. Directivity and gain property of a signal may be improved. The film antenna may be applied to a display device including a mobile communication device capable of transmitting and receiving in 3G or higher, for example, 5G of high-frequency band, to improve radiation properties and optical properties such as transmittance.

11 Claims, 4 Drawing Sheets

(58) Field of Classification Search
CPC ..... H01Q 9/0407; H01Q 9/045; H01Q 1/38; H01Q 3/26; H01Q 3/2658
See application file for complete search history.

(56) References Cited

U.S. PATENT DOCUMENTS

| | | | | |
|---|---|---|---|---|
| 2010/0167666 | A1 | 7/2010 | Choudhury et al. | |
| 2015/0309626 | A1* | 10/2015 | Prendergast | G06F 3/0443 345/173 |
| 2016/0056544 | A1* | 2/2016 | Garcia | H01Q 21/28 343/725 |
| 2016/0079666 | A1* | 3/2016 | Camilleri | H01Q 3/24 342/368 |
| 2016/0093939 | A1* | 3/2016 | Kim | H01Q 1/243 343/720 |
| 2017/0093023 | A1* | 3/2017 | Cai | G06F 3/041 |
| 2019/0058264 | A1* | 2/2019 | Jung | H01Q 1/243 |
| 2020/0076035 | A1* | 3/2020 | Huh | H01Q 1/364 |
| 2020/0194896 | A1* | 6/2020 | Huh | H01Q 1/44 |
| 2020/0201470 | A1* | 6/2020 | Oh | H01Q 1/52 |
| 2020/0227819 | A1* | 7/2020 | Oh | G06F 3/0412 |
| 2020/0227835 | A1* | 7/2020 | Kim | H01Q 21/065 |
| 2020/0243959 | A1* | 7/2020 | Ryu | H01Q 1/22 |
| 2020/0251807 | A1* | 8/2020 | Oh | G02B 5/20 |
| 2020/0259245 | A1* | 8/2020 | Kim | H01Q 9/0407 |
| 2020/0266525 | A1* | 8/2020 | Kim | H01Q 1/38 |
| 2020/0350695 | A1* | 11/2020 | Kim | H01Q 9/16 |
| 2020/0379607 | A1* | 12/2020 | Oh | H01Q 9/045 |
| 2020/0403315 | A1* | 12/2020 | Huh | H01Q 1/48 |
| 2020/0411959 | A1* | 12/2020 | Ryu | H01P 5/08 |
| 2021/0066790 | A1* | 3/2021 | Park | H01Q 1/50 |
| 2021/0083387 | A1* | 3/2021 | Oh | H01Q 15/168 |
| 2021/0126348 | A1* | 4/2021 | Kim | H01Q 21/28 |
| 2021/0141426 | A1* | 5/2021 | Kim | G06F 1/1626 |
| 2021/0203056 | A1* | 7/2021 | Huh | H01P 3/006 |
| 2021/0382573 | A1* | 12/2021 | Huh | H01Q 1/243 |

FOREIGN PATENT DOCUMENTS

| | | | |
|---|---|---|---|
| JP | 05-206719 | A | 8/1993 |
| JP | H11-177336 | A | 7/1999 |
| JP | 2017-147487 | A | 8/2017 |
| JP | 2017-175540 | A | 9/2017 |
| KR | 10-0563927 | B1 | 3/2006 |
| KR | 10-0795778 | B1 | 1/2008 |
| KR | 10-2013-0095451 | A | 8/2013 |
| KR | 10-2016-0027446 | A | 3/2016 |
| KR | 10-1744886 | B1 | 6/2017 |

OTHER PUBLICATIONS

International Search Report for PCT/KR2019/000//8 dated May 3, 2019.

Notice of Allowance dated Oct. 5, 2021 from Japan Intellectual Property Office in a counterpart Japanese Patent Application No. 2020-538932 (all the cited references are listed in this IDS.) (English translation is also submitted herewith.).

* cited by examiner

FILM ANTENNA AND DISPLAY DEVICE COMPRISING SAME

CROSS REFERENCE TO RELATED APPLICATIONS AND CLAIM OF PRIORITY

The present application is a continuation application to International Application No. PCT/KR2019/000778 with an International Filing Date of Jan. 18, 2019, which claims the benefit of Korean Patent Application No. 10-2018-0006484 filed on Jan. 18, 2018 at the Korean Intellectual Property Office, the disclosures of which are incorporated by reference herein in their entirety.

BACKGROUND

1. Field

The present invention relates to a film antenna and a display device including the same. More particularly, the present invention related to a film antenna including an electrode pattern and a display device including the same.

2. Description of the Related Art

As information technologies have been developed, a wireless communication technology such as Wi-Fi, Bluetooth, etc., is combined with a display device in, e.g., a smartphone. In this case, an antenna may be combined with the display device to provide a communication function.

Mobile communication technologies have been rapidly developed, and an antenna capable of operating an ultra-high frequency communication is needed in the display device.

For example, in a recent 5G high frequency range communication, as a wavelength becomes shorter, a signal transmission/reception may be blocked, and a frequency band capable of transmission/reception may be narrower to be vulnerable to signal loss and signal blocking. Thus, demands for a high frequency antenna having desired directivity, gain and signaling efficiency are increasing.

Further, as a display device including the antenna becomes further thinner and light-weighted, a space for the antenna may be also reduced. Accordingly, a high frequency and broadband signal transmission/reception may not be easily implemented in a limited space.

For example, Korean Published Patent Application No. 2013-0095451 discloses an antenna integrated into a display panel, however, fails to provide solutions to the above issues.

SUMMARY

According to an aspect of the present invention, there is provided a film antenna having improved signaling efficiency and reliability.

According to an aspect of the present invention, there is provided a display device including a film antenna having improved signaling efficiency and reliability.

The above aspects of the present invention will be achieved by the following features or constructions:

(1) a film antenna, comprising: a single dielectric layer; a plurality of radiation patterns commonly arranged on an upper surface of the single dielectric layer to form a phased array.

(2) The film antenna according to the above (1), further comprising a transmission line extending from each of the radiation patterns and a signal pad connected to one end of the transmission line.

(3) The film antenna according to the above (2), further comprising a ground pad adjacent to the signal pad, the signal pad disposed between a pair of the ground pads.

(4) The film antenna according to the above (2), further comprising a circuit board including a connection wiring connected to the signal pad; and a driving integrated circuit (IC) chip disposed on the circuit board to individually control the radiation pattern through the connection wiring.

(5) The film antenna according to the above (4), wherein the driving IC chip includes driving pads electrically connected to each of the radiation patterns to feed signals having different phases.

(6) The film antenna according to the above (5), wherein each of the driving pads is individually connected to each of the signal pads.

(7) The film antenna according to the above (4), wherein the circuit board further includes a ground wiring, and the connection wiring is disposed between a pair of ground wirings.

(8) The film antenna according to the above (1), wherein a distance between central lines of the adjacent radiation patterns is $\lambda/2$ or more.

(9) The film antenna according to the above (1), wherein the radiation pattern including a mesh structure.

(10) The film antenna according to the above (9), further comprising a dummy pattern arranged around the radiation pattern and having a mesh structure equal to the mesh structure of the radiation pattern.

(11) The film antenna according to the above (1), wherein the radiation pattern includes at least one selected from a group consisting of Ag, Au, Cu, Al, Pt, Pd, Cr, Ti, W, Nb, Ta, V, Fe, Mn, Co, Ni, Zn, Sn and an alloy thereof.

(12) The film antenna according to the above (1), further comprising a ground layer formed on a lower surface of the dielectric layer.

(13) A display device comprising the film antenna according to any one of the above (1) to (12).

In the film antenna according to embodiments of the present invention, antenna patterns having different phases to each other may be arranged independently to be individually controlled through a driving IC chip. Therefore, while preventing interference between antenna patterns, signal transmission/reception or radiation driving can be independently maintained. Additionally, since antenna patterns having phases different to each other may be continuously arranged, signal directivity can be increased through a partial overlap of a waveform of a received signal, so that overall gain of the film antenna can be improved.

Additionally, resonant frequencies of each antenna pattern may be overlapped by phased array of the antenna pattern, so that wideband signal transmission/reception may be implemented.

The film antenna may be applied to a display device including a mobile communication device capable of transmitting and receiving in 3G or higher, for example, 5G of high-frequency band, to improve radiation properties and optical properties such as transmittance.

DETAILED DESCRIPTION OF THE EMBODIMENTS

According to exemplary embodiments of the present invention, there is provided a film antenna including a plurality of radiation patterns which are driven independently of each other and have different phases to each other, so that the film antenna may have improved directivity and gain property.

The film antenna may be a micro-strip patch antenna fabricated as a transparent film. The film antenna may be applied to communication devices for mobile communication such as 3G to 5G.

Additionally, exemplary embodiments of the present invention provide a display device including the film antenna.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
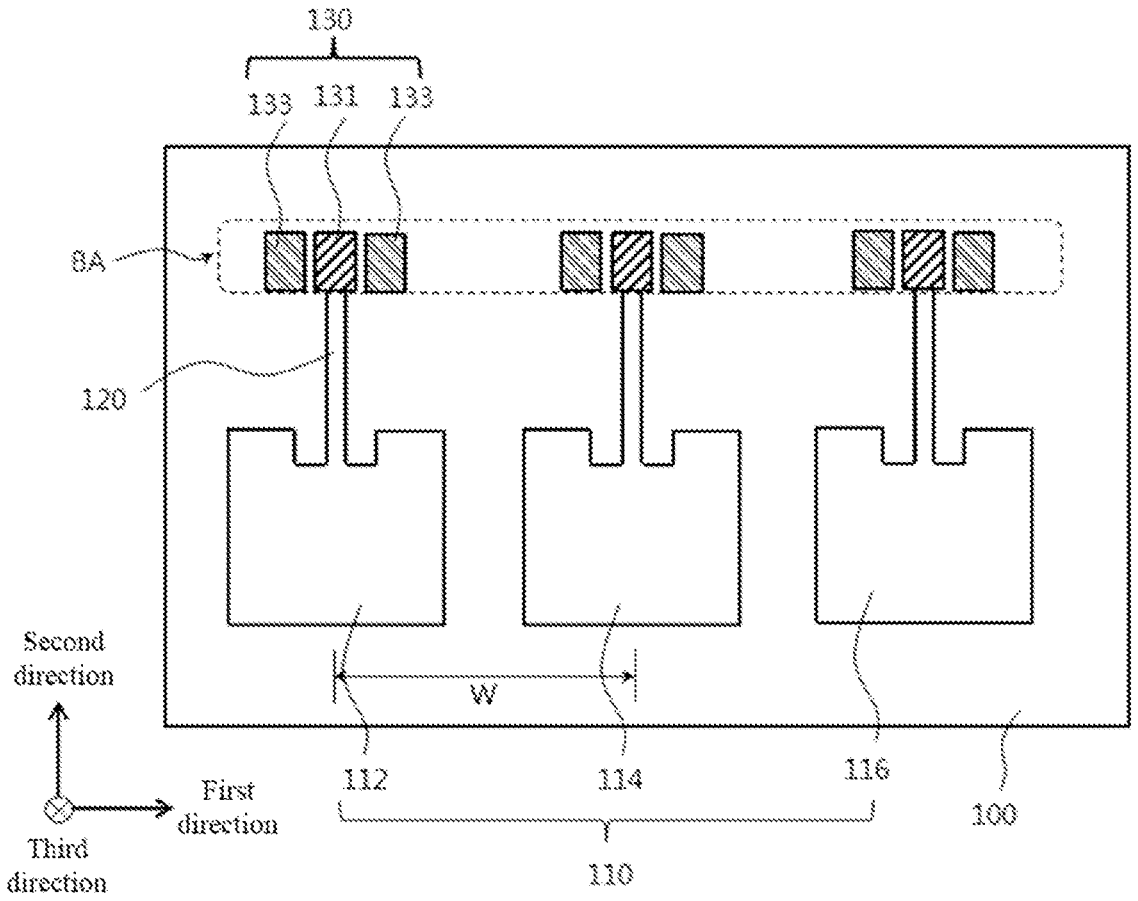
FIG. 1 and FIG. 2 are a schematic top-planar view and a cross-sectional view illustrating a film antenna in accordance with exemplary embodiments, respectively.
Figure 2:
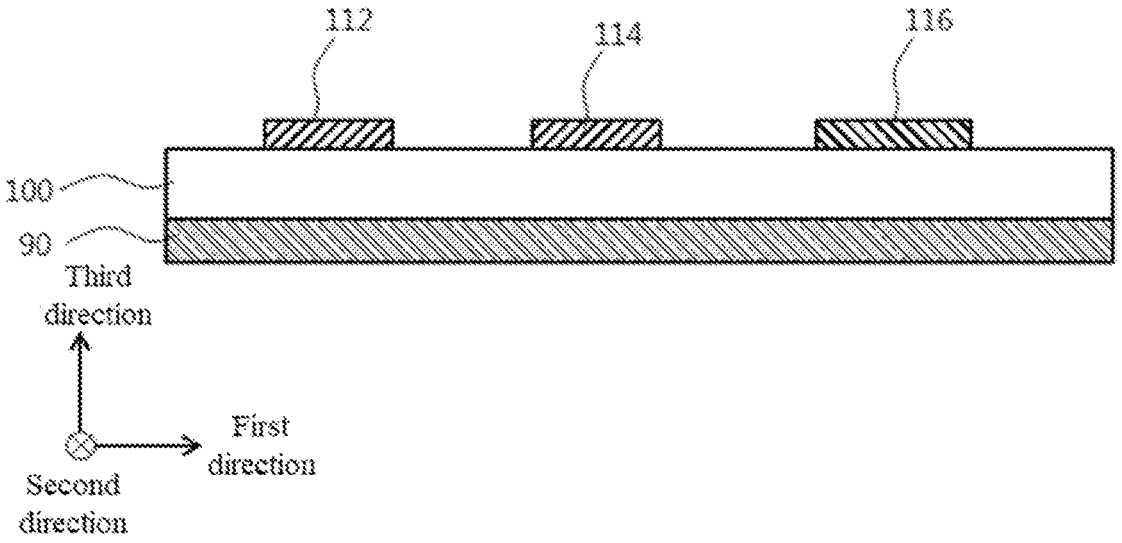

FIG. 1 and FIG. 2 are a schematic top-planar view and a cross-sectional view illustrating a film antenna in accordance with exemplary embodiments, respectively.

In the accompanying drawings, two directions being parallel to a top surface of a dielectric layer 100 and crossing each other are defined as a first direction and a second direction. The first direction may correspond to a width direction of the film antenna, the second direction may correspond to a length direction of the film antenna. A thickness direction may define a third direction of the film antenna. Definitions of the above-described directions may be equally applied to the other drawings.

Referring to FIG. 1 and FIG. 2, a film antenna may include a plurality of antenna patterns formed on a dielectric layer 100. Each of antenna patterns may include a radiation pattern 110, a transmission line 120, and a pad electrode 130 connected to one end of the transmission line 120. As illustrated in FIG. 2, a ground layer 90 may further be formed on a lower surface of the dielectric layer 100.

The dielectric layer 100 may include an insulating material having a predetermined dielectric constant. The dielectric layer 100 may include, for example, inorganic insulating materials such as silicon oxide, silicon nitride, and metal oxide, or organic insulating materials such as epoxy resin, acrylic resin, and imide-based resin. The dielectric layer 100 may function as a film substrate of a film antenna on which the radiation pattern 110 is formed.

For example, a transparent film may be provided as the dielectric layer 100. The transparent film may include, e.g., a thermoplastic resin such as a polyester-based resin such as polyethylene terephthalate, polyethylene isophthalate, polyethylene naphthalate, polybutylene terephthalate, or the like; a cellulose-based resin such as diacetyl cellulose, triacetyl cellulose, or the like; a polycarbonate-based resin; an acrylic resin such as polymethyl(meth)acrylate, polyethyl(meth) acrylate, or the like; a styrene-based resin such as polystyrene, acrylonitrile-styrene copolymer, or the like; a polyolefin-based resin such as polyethylene, polypropylene, a cyclo-based polyolefin, a norbornene-structured polyolefin, ethylene-propylene copolymer, or the like; a vinyl chloride-based resin; an amide-based resin such as nylon, an aromatic polyamide, or the like; an imide-based resin; a polyether sulfone-based resin; a sulfone-based resin; a polyether ether ketone-based resin; a polyphenylene sulfide-based resin; a vinyl alcohol-based resin; a vinylidene chloride-based resins; a vinyl butyral-based resin; an allylate-based resin; a polyoxymethylene-based resin; an epoxy-based resin. These may be used alone or in a combination thereof. Additionally, a transparent film formed of a thermosetting resin or a UV curable resin such as (meth)acrylic resin, urethane-based resin, acryl-urethane-based resin, epoxy-based resin, or silicone-based resin may be used as the dielectric layer 100.

In some embodiments, a dielectric constant of the dielectric layer 100 may be controlled in a range from about 1.5 to about 12. If the dielectric constant exceeds about 12, a driving frequency may be excessively decreased and a desired high-frequency antenna operation may not be implemented.

A plurality of radiation patterns may be arranged independently of each other on an upper surface of the dielectric layer 100. For example, as illustrated in FIG. 1, a first radiation pattern 112, a second radiation pattern 114, and a third radiation pattern 116 may be arranged along the first direction. Although three antenna patterns are illustrated in FIG. 1 for convenience of description, four or more antenna patterns can be arranged along the first direction.

According to exemplary embodiments, the radiation patterns may form a phased array, and the first to third radiation patterns 112, 114, and 116 may have different phases.

For example, the second radiation pattern 114 may be driven with a first phase difference ($\pm\alpha$) based on the first radiation pattern 112, and the third radiation pattern 116 may be driven with a second phase difference ($\pm\beta$). The first phase difference and the second phase difference may be different from each other, for example, $\alpha$ and $\beta$ may be different from each other.

For example, a phase difference value may be sequentially increased from a reference radiation pattern. For example, as illustrated in FIG. 1, when the first radiation pattern 112 is provided as a reference radiation pattern, a phase difference value may increase along the first direction from the first radiation pattern 112.

In one embodiment, when a reference radiation pattern (e.g., the second radiation pattern 114) is located at a central portion, radiation patterns may be arranged in both side directions expanding from the reference radiation pattern while increasing a phase difference value.

The above-described phased array is an example and may be appropriately changed in consideration of radiation efficiency.

The transmission line 120 may be branched and extended from each radiation pattern 110. For example, the transmission line 120 may be extended from each radiation pattern 110 and be electrically connected to the pad electrode 130.

According to some embodiments, the transmission line 120 and the radiation pattern 110 may include a same conductive material. For example, the transmission line 120 and the radiation pattern 110 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn) or an alloy thereof. These may be used alone or in combination of two or more. For example, the transmission line 120 and the radiation pattern 110 may include Ag or an Ag alloy to implement a low resistance, e.g. a silver-palladium-copper (APC) alloy.

In some embodiments, the transmission line 120 and the radiation pattern 110 may include a transparent metal oxide such as indium tin oxide (ITO), indium zinc oxide (IZO), indium zinc tin oxide (ITZO), or zinc oxide (ZnOx).

For example, the transmission line 120 and the radiation pattern 110 may be formed together by patterning a conductive layer including the above-described conductive material, in this case, the transmission line 120 may be integrally connected to the radiation pattern 110 and be substantially provided as a single member with the radiation pattern 110.

According to exemplary embodiments, the pad electrode 130 may include a signal pad 131 and a ground pad 133. According to some embodiments, the signal pad 131 may be disposed between two ground pads 133.

The signal pad 131 may be connected to a wiring of a circuit board such as a flexible printed circuit board (FPCB) to transmit a feed signal from a driving integrated circuit (IC) chip to the radiation pattern 110. As described above, different feed signals from each other may be transmitted via the signal pad 131 so as to have a phase difference in each of the radiation patterns 112, 114, and 116 through the driving IC chip. The circuit board may be bonded to the pad electrode 130 in the bonding area (BA) of the film antenna.

As each signal pad 131 connected to each radiation pattern 110 may be sandwiched by the ground pads 133, signal interference between neighboring antenna patterns may be reduced, so that independent driving and independent radiation property can be further enhanced.

The pad electrode 130 may be formed to include a conductive material substantially equal to or similar to the radiation pattern 110 and the transmission line 120.

In some embodiments, the ground layer 90 may be further disposed on a lower surface of the dielectric layer 100. For example, a capacitance or an inductance may be formed in the third direction between the radiation patterns 112, 114, and 116 and the ground layer 90 by the dielectric layer 100, so that a frequency band in which the film antenna can drive or sense may be controlled. For example, the film antenna may be provided as a vertical radiation antenna.

The ground layer 90 may include a metal, an alloy, or a transparent conductive oxide. In one embodiment, a conductive member of a display device in which the film antenna is mounted may be provided as the ground layer 90.

The conductive member may include, for example, a gate electrode, various wires such as a scan line or a data line, or various electrodes such as a pixel electrode or a common electrode of a thin film transistor (TFT) included in a display panel.

According to some embodiments, the ground layer 90 may be electrically connected to the ground pad 133 through a connection ground (not shown). For example, the connection ground may have a structure of a contact or a via formed in the dielectric layer 100.

As described above, each of the radiation patterns 112, 114, and 116 of antenna patterns may be arranged to form a phased array, and feed signals having different phases may be individually distributed to each of the radiation patterns 112, 114, and 116 through the independent signal pad 131.

Accordingly, waveforms of resonant frequencies generated from each of the radiation patterns 112, 114, and 116 may be partially overlapped to improve directivity of transmission/reception signal, so that a gain value may also be increased. Also, according to overlapping of frequency waveforms that can be received, bandwidth that can be transmitted and received can also be expanded.

Additionally, a transparent flexible film antenna can be easily implemented by disposing the radiation patterns 112, 114, and 116 having different phases on a same layer or a same level.

According to some embodiments, a distance between neighboring radiation patterns 110 (e.g., a distance between center lines of neighboring radiation patterns) may be half wavelength ($\lambda/2$) or more with respect to a wavelength ($\lambda$) corresponding to a resonance frequency of the film antenna in consideration of directivity improvement and independent driving according to the phase shift, and may be preferably $\lambda$ or more.

In some embodiments, a length of the pad electrode 130 (length in the second direction) may be about $\lambda/4$ or more for impedance matching with a circuit board.

Figure 3:
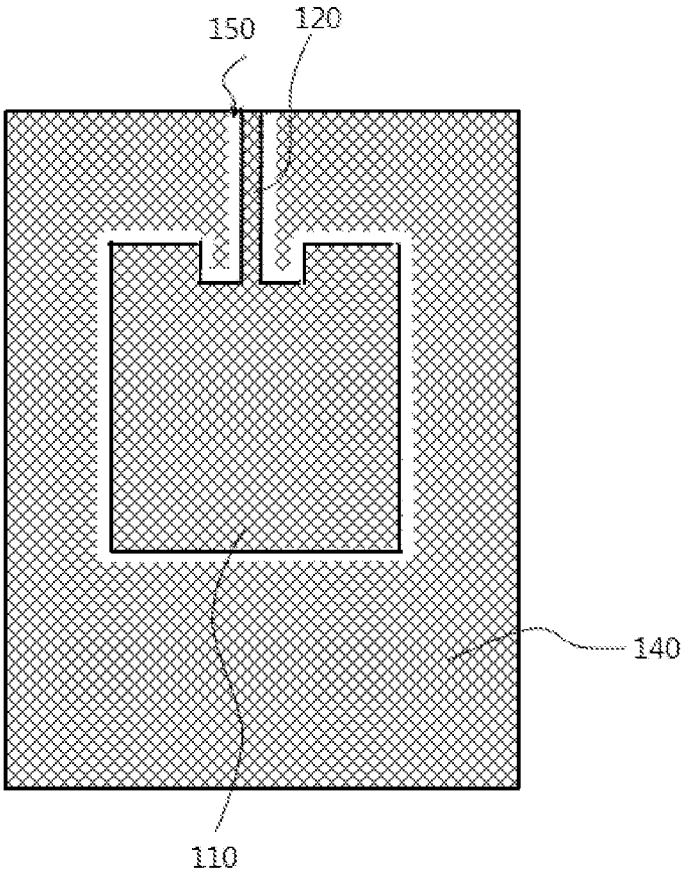
FIG. 3 is a schematic top-planar view illustrating a structure of an antenna pattern in accordance with exemplary embodiments.

FIG. 3 is a schematic top-planar view illustrating a structure of an antenna pattern in accordance with exemplary embodiments. For convenience of description, one antenna pattern is illustrated in FIG. 3, but a plurality of antenna patterns may be arranged on the dielectric layer 100.

Referring to FIG. 3, the radiation pattern 110 may include a mesh structure. For example, the mesh structure may be defined by electrode lines intersecting each other.

In some embodiments, a dummy pattern 140 may be formed around the radiation pattern 110. The dummy pattern 140 may also include a mesh structure substantially equal to or similar to the radiation pattern 110. For example, the dummy pattern 140 may be divided through a separation region 150 in which the mesh structure is broken.

Accordingly, a structure of an electrode line around the radiation pattern 110 may be uniformized to prevent that the antenna pattern is seen to a user. Additionally, an overall transmittance of a film antenna may be improved through an application of the mesh structure.

As described above, the transmission line 120 may be integrally connected to the radiation pattern 110, and may include the mesh structure.

Figure 4:
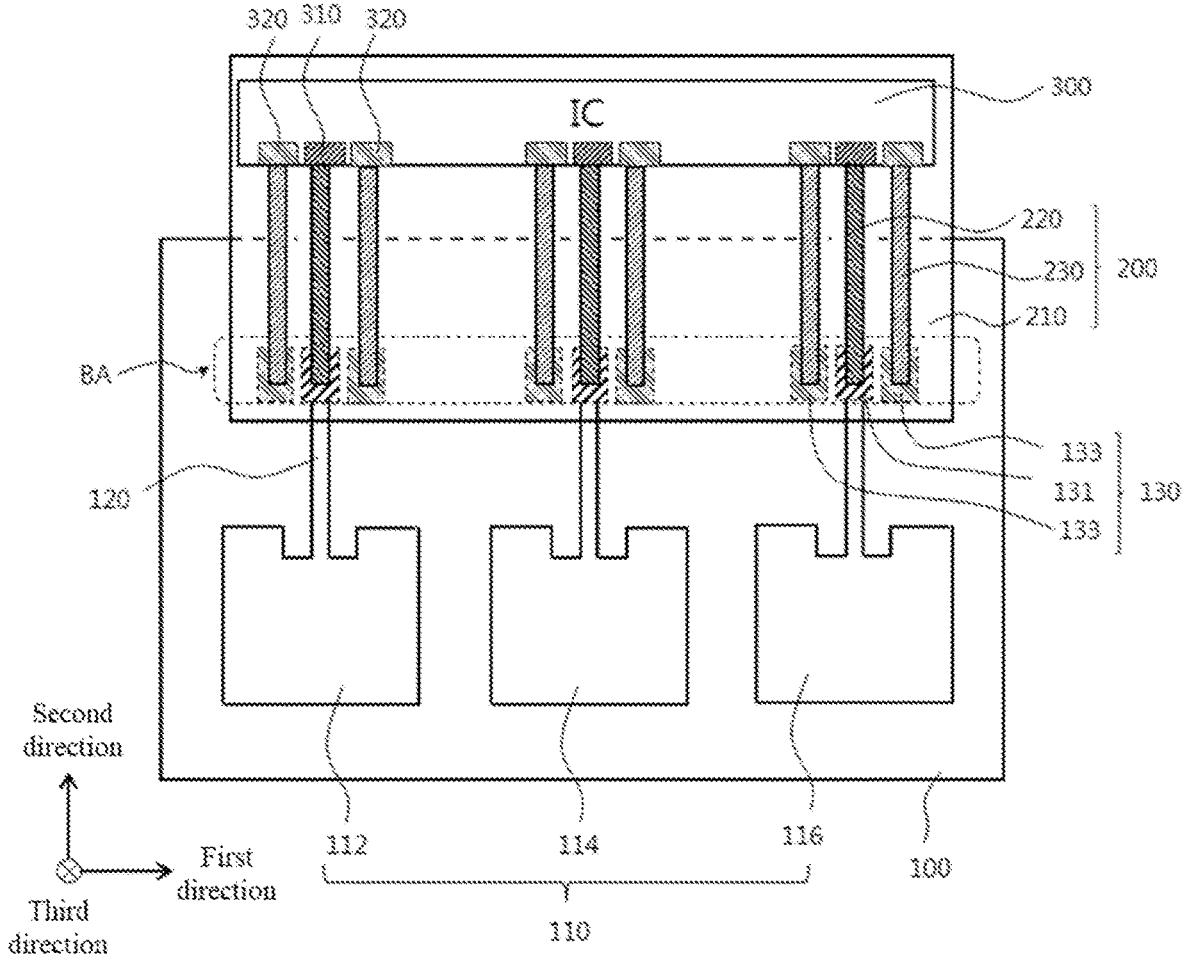
FIG. 4 and FIG. 5 a schematic top-planar view and a cross-sectional view illustrating a film antenna in accordance with exemplary embodiments, respectively.
Figure 5:
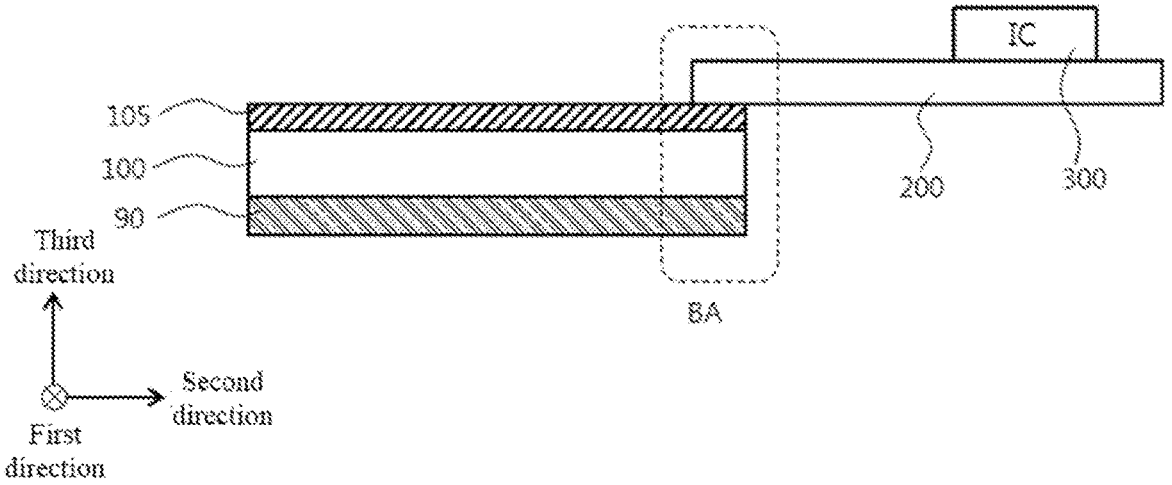

FIG. 4 and FIG. 5 a schematic top-planar view and a cross-sectional view illustrating a film antenna in accordance with exemplary embodiments, respectively.

FIG. 4 and FIG. 5 illustrate a structure of a film antenna in which a circuit connection structures are merged together. The circuit connection structure may include a circuit board 200 and a driving IC chip 300.

As shown in FIG. 5, the circuit board 200 may be electrically connected to an upper electrode layer 105 of a film antenna in a bonding area BA of the film antenna. The upper electrode layer 105 may include a plurality of antenna patterns forming a phased array described with reference to FIG. 1. The upper electrode layer 105 may include radiation patterns 110, a transmission line 120, and a pad electrode 130, and the circuit board 200 may be connected to the pad electrode 130.

In some embodiments, the pad electrode 130 may be disposed on an upper layer or an upper level of the radiation pattern 110 and the transmission line 120. In this case, the pad electrode 130 may have a solid metal structure to reduce signal loss and contact resistance with the circuit board 200. In one embodiment, as described with reference to FIG. 3, the radiation pattern 110 may be formed to include a mesh structure to improve transmittance, and the pad electrode 130 may be formed as a solid structure to improve signal rate.

For example, the circuit board 200 may have a FPCB structure, and may include a flexible core 210 and connection wirings 220. The flexible core 210 may include a flexible resin substrate including an epoxy-based resin, an acrylic resin, a polyimide-based resin, a liquid crystal polymer (LCP), and the like.

The connection wirings 220 may be arranged on the flexible core 210 or may be printed or embedded in the flexible core 210. A coverlay layer covering the connection wirings 220 may be further formed on the flexible core 210.

According to exemplary embodiments, each connection wiring 220 may be individually and independently connected to the signal pad 131 connected to each antenna pattern. The connection wiring 220 may be directly contact with the signal pad 131 or may be electrically connected to the signal pad 131 through a contact (not shown) formed in the flexible core 210.

In some embodiments, a conductive connection member, such as an anisotropic conductive film (ACF), may be inserted between the connection wiring 220 and the signal pad 131.

The driving IC chip 300 may be disposed on the circuit board 200. The driving IC chip 300 may include driving pads 310 and a control circuit (not shown) connected to the driving pads 310.

For example, the connection wiring 220 of the circuit board 200 may extend in the first direction and be electrically connected to the driving pad 310 of the driving IC chip 300. The driving pad 310 may be formed to correspond to each connection wiring 220.

According to exemplary embodiments, through each driving pad 310, radiation patterns 112, 114, and 116 arranged with a phased array may be individually and independently controlled, and each radiation pattern 112, 114 and 116 may be fed.

The circuit board 200 may further include a ground wiring 230, and the driving IC chip 300 may further include a ground circuit pad 320.

According to example embodiments, the ground wiring 230 of the circuit board 200 may be individually connected to the ground pad 133 and connected to the ground circuit pad 320 of the driving IC chip 300.

Regarding to the circuit board 200, each connection wiring 220 and a pair of ground wirings 230 may be provided for each antenna pattern of a film antenna. Each connection wiring 220 may be connected to each of the radiation patterns 112, 114, and 116 arranged to enable different phase-difference radiation, so that individual and independent radiation may be implemented, and the connection wiring 220 may be disposed between a pair of ground wirings 230 to implement a noise shielding function together.

Figure 6:
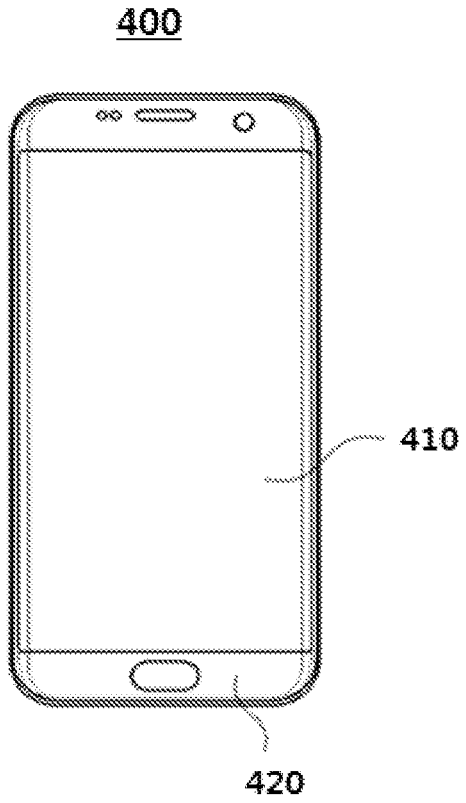
FIG. 6 is a schematic top-planar view illustrating a display device in accordance with exemplary embodiments.

FIG. 6 is a schematic top-planar view illustrating a display device in accordance with exemplary embodiments. For example, FIG. 6 shows an external shape including a window of a display device.

Referring to FIG. 6, a display device 400 may include a display area 410 and a peripheral area 420. For example, the peripheral area 420 may be disposed at both lateral portions and/or both end portions of the display area 410.

In some embodiments, the film antenna described above may be inserted in the peripheral area 420 of the display device 400 as a patch structure. In some embodiments, the bonding area BA of the film antenna may be disposed to correspond to the peripheral area 420 of the display device 400.

The peripheral area 420 may correspond to, e.g., a light-shielding portion or a bezel portion of an image display device. Additionally, the circuit board 200 and the driving IC chip 300 may be disposed at the peripheral area 420.

By disposing the bonding area BA of the film antenna to be adjacent to the driving IC chip in the peripheral area 420, a signal transmission/reception path can be shortened to suppress signal loss.

While embodiments of the invention concept have been described with reference to the attached drawings, it will be understood by those of ordinary skill in the art that various changes in form and detail may be made therein without changing the spirit and the features of the present invention. The exemplary embodiments should be considered in a descriptive sense only and not for purposes of limitation.

What is claimed is:

1. A film antenna, comprising:

a single dielectric layer;

a plurality of radiation patterns commonly arranged on an upper surface of the single dielectric layer to form a phased array;

a transmission line extending from each of the radiation patterns;

a signal pad connected to one end of the transmission line; and a ground pad adjacent to the signal pad, the signal pad disposed between a pair of the ground pads.

2. The film antenna according to claim 1, wherein a distance between central lines of the adjacent radiation patterns is $\lambda/2$ or more.

3. The film antenna according to claim 1, wherein the radiation pattern includes at least one selected from a group consisting of Ag, Au, Cu, Al, Pt, Pd, Cr, Ti, W, Nb, Ta, V, Fe, Mn, Co, Ni, Zn, Sn and an alloy thereof.

4. The film antenna according to claim 1, further comprising a ground layer formed on a lower surface of the dielectric layer.

5. A display device comprising the film antenna according to claim 1.

6. A film antenna comprising:

a single dielectric layer;

a plurality of radiation patterns commonly arranged on an upper surface of the single dielectric layer to form a phased array;

a transmission line extending from each of the radiation patterns;

a signal pad connected to one end of the transmission line;

a circuit board including a connection wiring connected to the signal pad; and a driving integrated circuit (IC) chip disposed on the circuit board to individually control the radiation pattern through the connection wiring, wherein the circuit board further includes a ground wiring; and the connection wiring is disposed between a pair of ground wirings.

7. The film antenna according to claim 6, wherein the driving IC chip includes driving pads electrically connected to each of the radiation patterns to feed signals having different phases.

8. The film antenna according to claim 7, wherein each of the driving pads is individually connected to each of the signal pads.

9. A display device comprising the film antenna according to claim 6.

10. A film antenna comprising:

a single dielectric layer;

a plurality of radiation patterns commonly arranged on an upper surface of the single dielectric layer to form a phased array, the radiation pattern including a mesh structure; and a dummy pattern arranged around the radiation pattern and having a mesh structure equal to the mesh structure of the radiation pattern.

11. A display device comprising the film antenna according to claim 10.

* * * * *